US006093034A

United States Patent [19]

Tan

[11] Patent Number: 6,093,034

[45] Date of Patent: Jul. 25, 2000

[54] PCMCIA TERMINAL

[75] Inventor: Ying Wu Tan, Tao-Yuan Hsien, Taiwan

[73] Assignee: Speed Tech Corp., Tao-Yuan Hsien, Taiwan

[21] Appl. No.: 09/292,908

[22] Filed: Apr. 16, 1999

[30] Foreign Application Priority Data

May 8, 1998 [TW] Taiwan ..... 87207114

[51] Int. Cl.[7] ..... H01R 9/09

[52] U.S. Cl. ..... 439/80

[58] Field of Search ..... 439/79, 80, 83, 439/876, 946, 946.2; 361/737

[56] References Cited

U.S. PATENT DOCUMENTS 3,362,008 1/1968 Berg ..... 339/258
3,363,224 1/1968 Gluntz ..... 339/258
3,566,342 2/1971 Schitt et al. ..... 339/217
3,663,931 5/1972 Brown ..... 339/218
5,352,125 10/1994 Banakis et al. ..... 439/83

*Primary Examiner*—Steven L. Stephan
*Assistant Examiner*—V. Johnson
*Attorney, Agent, or Firm*—Pro-Techtor International Services

[57] ABSTRACT

A PCMCIA terminal having an elongated mounting base of substantially U-shaped cross section at one end for mounting in a PCMCIA connector, an elongated connecting strip longitudinally forwardly extended from one end of the elongated mounting base, two reinforcing side ribs downwardly perpendicularly raised from two opposite lateral sides of a horizontal middle portion of the elongated connecting strip, and a tongue raised from the horizontal middle portion of the elongated connecting strip and terminating in a horizontal contact portion for soldering to a contact at a circuit board.

3 Claims, 2 Drawing Sheets

PCMCIA TERMINAL

BACKGROUND OF THE INVENTION

The present invention relates to a terminal for a PCMCIA card, and more particularly to such a PCMCIA terminal that has reinforcing side ribs for protection against deformation, and a tongue with a horizontal contact portion for soldering to a contact at the circuit board positively.

A PCMCIA card is a standard interface commonly used in notebook computers and other personal digital assistants. A regular PCMCIA card, as shown in FIG. 1, is comprised of a top cover shell A, a bottom cover shell B, and a circuit board C retained between the cover shells A, B. The circuit board C comprises a first connector D at one end for connection to a PCMCIA slot in a computer, and a second connector E at an opposite end for connection to an external peripheral apparatus. The second connector E comprises a plurality of metal terminals E1 soldered to respective contacts C1 at the circuit board C. FIG. 2 shows the terminals E1 for this purpose. The terminals commonly comprise two mounting legs for clamping on the top and bottom sides of the circuit board and soldering to respective contacts. Because the mounting legs are flat members, they tend to be damaged, or forced to deform before installation of the connector. When the mounting legs are deformed or damaged, the connector becomes useless. Furthermore, the plain design of the mounting legs makes the worker difficult to properly control the contact area between each mounting leg and the corresponding contact, thereby causing the soldering quality unable to be properly maintained.

SUMMARY OF THE INVENTION

The present invention has been accomplished to provide a metal terminal for a PCMCIA connector which eliminates the aforesaid problems. It is the main object of the present invention to provide a PCMCIA terminal which has reinforced side ribs against deformation. According to one aspect of the present invention, the PCMCIA terminal comprises a mounting base at one end for mounting in a PCMCIA connector, and a connecting strip for connecting to a circuit board, wherein the connecting strip is reinforced with reinforcing side ribs for protection against deformation. According to another aspect of the present invention, the connecting strip is provided with a tongue having a backward contact portion for soldering to a contact at the circuit board.

DETAILED DESCRIPTION OF THE PREFERRED EMBODIMENT

Figure 1:
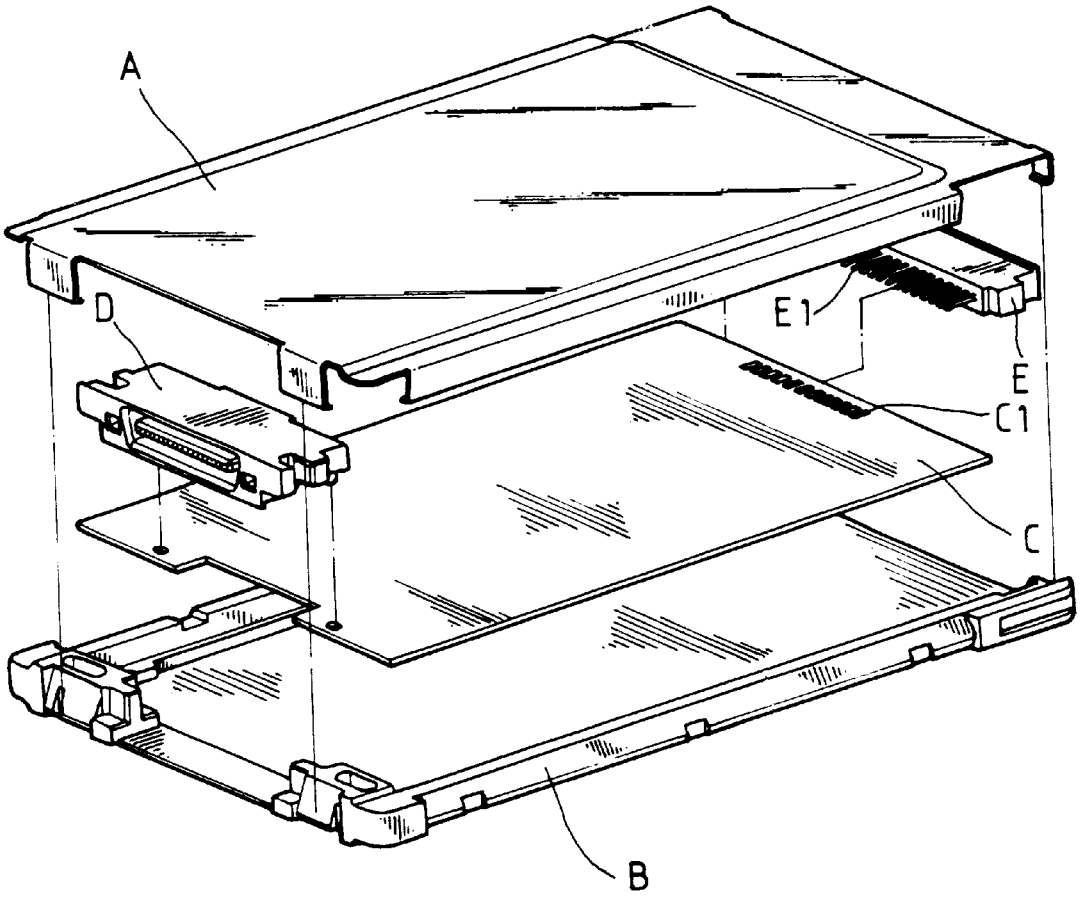
FIG. 1 is an exploded view of a regular PCMCIA card.
Figure 2:
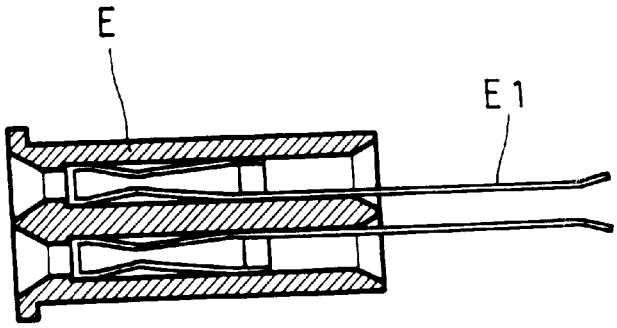
FIG. 2 illustrates the PCMCIA terminals according to the prior art.
Figure 3:
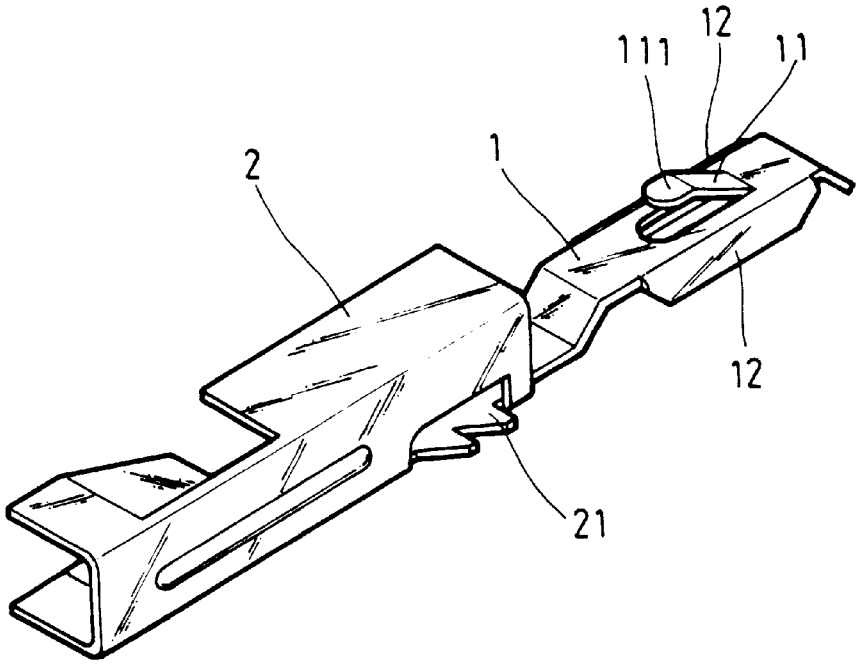
FIG. 3 is a perspective view of a PCMCIA terminal according to the present invention.

Referring to FIG. 3, a PCMCIA terminal is shown comprising an elongated mounting base 2 of substantially U-shaped cross section at one end, a serrated retaining portion 21 integral with the mounting base 2 at one side, an elongated connecting strip 1 longitudinally forwardly extended from one end of the elongated mounting base 2, the elongated connecting strip 1 having a horizontal middle portion and two oblique end pieces outwardly downwards extended from two opposite ends of the horizontal middle portion, two reinforcing side ribs 12 downwardly perpendicularly raised from two opposite lateral sides of the horizontal middle portion of the elongated connecting strip 1, and a tongue 11 raised from the horizontal middle portion of the elongated connecting strip 1 and formed of a part of the horizontal middle portion by stamping. The tongue 11 has a fixed end integral with the horizontal middle portion of the elongated connecting strip 1, and a free end terminating in a horizontal contact portion 111. The tongue 11 is so arranged that the horizontal contact portion 111 is aimed at the elongated mounting base 2. The design of the reinforcing side ribs 12 greatly improve the structural strength of the elongated connecting strip 1 against deformation.

Figure 4:
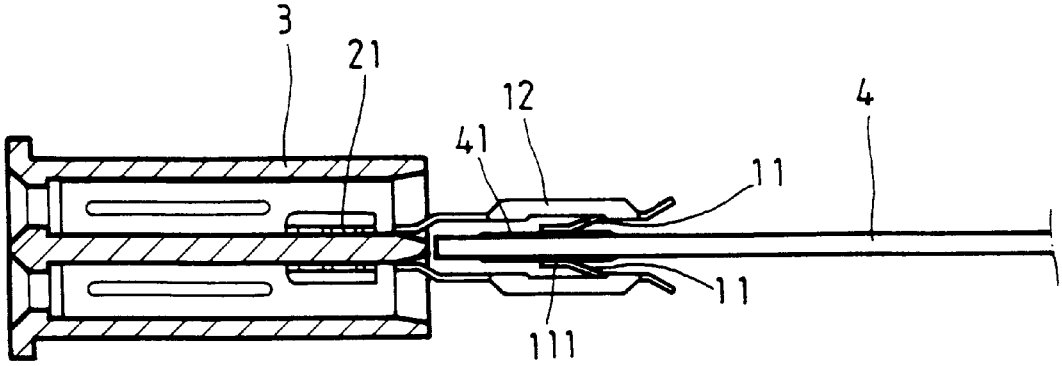
FIG. 4 is an installed view of the present invention, showing the mounting base and connecting strip of the PCMCIA terminal respectively fastened to the PCMCIA connector and the circuit board.

Referring to FIG. 4 and FIG. 3 again, the elongated mounting base 2 of the PCMCIA terminal is mounted in a PCMCIA connector 3, and the elongated connecting strip 1 is connected to a circuit board 4. When the elongated mounting base 2 is mounted in the PCMCIA connector 3, the serrated retaining portion 21 is forced into engagement with an inside wall of the PCMCIA connector 3, causing the PCMCIA terminal to be firmly secured to the PCMCIA connector 3. As illustrated in FIG. 4, two PCMCIA terminals are arranged in pair with the horizontal contact portions 111 ofthe tongues 11 ofthe respective elongated connecting strips 1 directly welded to respective contacts 41 at both sides of the circuit board 4. Because the horizontal contact portions 111 of the tongues 11 of the two PCMCIA terminals are aimed at the PCMCIA connector 3, the circuit board 4 can be smoothly inserted into position and retained between the horizontal contact portions 111 of the tongues 11 of the two PCMCIA terminals, enabling the respective contacts 41 to be respectively positively soldered to the respective horizontal contact portions 111.

What the invention claimed is:

1. A PCMCIA terminal comprising an elongated mounting base of substantially U-shaped cross section at one end for mounting in a PCMCIA connector, an elongated connecting strip longitudinally forwardly extended from one end of said elongated mounting base, said elongated connecting strip having a horizontal middle portion and two oblique end pieces outwardly downwards extended from two opposite ends of said horizontal middle portion, two reinforcing side ribs downwardly perpendicularly raised from two opposite lateral sides of the horizontal middle portion of said elongated connecting strip, and a tongue raised from the horizontal middle portion of said elongated connecting strip for soldering to a contact at a circuit board.

2. The PCMCIA terminal of claim 1 wherein said tongue has a fixed end integral with the horizontal middle portion of said elongated connecting strip, and a free end terminating in a horizontal contact portion for soldering to the contact at the circuit board, said horizontal contact portion extending from said tongue in direction toward said elongated mounting base.

3. The PCMCIA terminal of claim 1 further comprising a serrated portion integral with said elongated mounting base at one side for engagement with an inside wall of the PCMCIA connector to secure said elongated mounting base to the PCMCIA connector.

* * * * *